US006927532B2

(12) United States Patent
Miyamoto et al.

(10) Patent No.: US 6,927,532 B2
(45) Date of Patent: Aug. 9, 2005

(54) RESISTOR FOR ELECTRON GUN ASSEMBLY WITH THE RESISTOR, AND CATHODE-RAY TUBE APPARATUS WITH THE RESISTOR

(75) Inventors: Noriyuki Miyamoto, Kodaira (JP); Yoshihisa Kaminaga, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/871,011

(22) Filed: Jun. 21, 2004

(65) Prior Publication Data

US 2004/0232818 A1 Nov. 25, 2004

Related U.S. Application Data

(63) Continuation of application No. PCT/JP03/12516, filed on Sep. 30, 2003.

(30) Foreign Application Priority Data

Oct. 16, 2002 (JP) ..... 2002-301943

(51) Int. Cl.[7] ..... H01J 29/46
(52) U.S. Cl. ..... 313/441; 313/440
(58) Field of Search ..... 313/417, 440, 313/441, 446, 449, 451, 456, 3

(56) References Cited

U.S. PATENT DOCUMENTS 6,515,424 B2 * 2/2003 Nakamura et al. ..... 315/3

FOREIGN PATENT DOCUMENTS

| | | |
|---|---|---|
| JP | 5-25160 | 6/1993 |
| JP | 7-123031 | 12/1995 |
| JP | 2001-210254 | 8/2001 |
| JP | 2002-260553 | 9/2002 |

* cited by examiner

*Primary Examiner*—Vip Patel
(74) *Attorney, Agent, or Firm*—Oblon, Spivak, McClelland, Maier & Neustadt, P.C.

(57) ABSTRACT

A resistor for an electron gun assembly includes an insulating substrate, a plurality of electrode elements provided on the insulating substrate, a resistor element provided on the insulating substrate and having a pattern for obtaining a predetermined resistance value between the electrode elements, an insulating coating layer that covers the resistor element, a plurality of metal terminals that are connected to the associated electrode elements, and a lead-out wire that extends from at least one of the electrode elements and is electrically connected to the resistor element. By extending and connecting the lead-out wire to a desired position on the resistor element, the resistor is made adaptable to various alterations and a desired resistance division ratio can exactly be obtained.

5 Claims, 3 Drawing Sheets

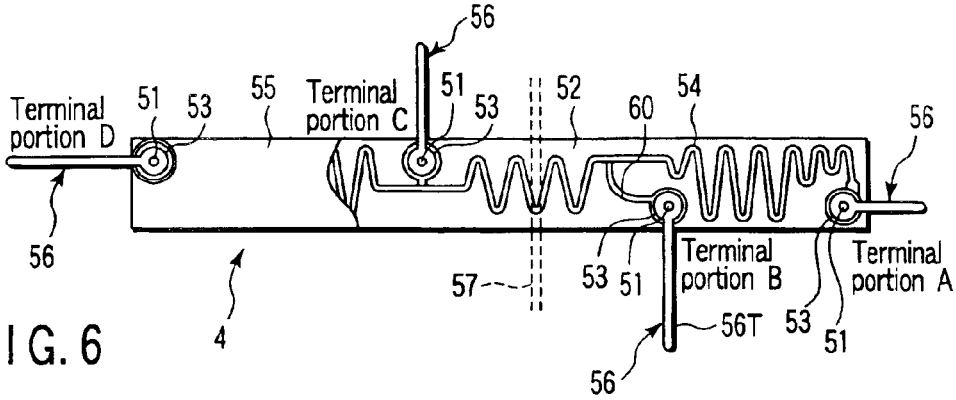

FIG. 6

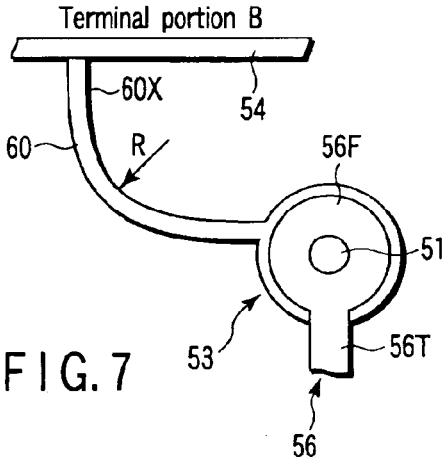

FIG. 7

| | Lead-out pattern specifications | Probability of occurrence of peel of lead-out pattern |
|---|---|---|
| Samples | Radius of curvature 0.1mm | 16% |
| | Radius of curvature 0.2mm | 14% |
| | Radius of curvature 0.3mm | 10% |
| | Radius of curvature 0.4mm | 5% |
| | Radius of curvature 0.5mm | 0% |
| | Radius of curvature 0.6mm | 0% |
| | Radius of curvature 1.0mm | 0% |
| | Radius of curvature 2.0mm | 0% |
| | Radius of curvature 5.0mm | 0% |
| | Radius of curvature 8.0mm | 0% |
| | Radius of curvature 10.0mm | 0% |
| | Radius of curvature 12.0mm | 0% |
| | Radius of curvature 5.0mm | 0% |
| | Straight-line design (FIG. 4) | 18% |

FIG. 8

RESISTOR FOR ELECTRON GUN ASSEMBLY WITH THE RESISTOR, AND CATHODE-RAY TUBE APPARATUS WITH THE RESISTOR

CROSS-REFERENCE TO RELATED APPLICATIONS

This is a Continuation Application of PCT Application No. PCT/JP03/12516, filed Sep. 30, 2003, which was not published under PCT Article 21(2) in English.

This application is based upon and claims the benefit of priority from prior Japanese Patent Application No. 2002-301943, filed Oct. 16, 2002, the entire contents of which are incorporated herein by reference.

BACKGROUND OF THE INVENTION

1. Field of the Invention

The present invention relates to a resistor for an electron gun assembly that is mounted in a cathode-ray tube apparatus, and more particularly to a resistor for an electron gun assembly, the resistor being configured to apply a voltage, which is divided with a predetermined resistance division ratio, to a grid electrode provided in the electron gun assembly, an electron gun assembly with the resistor, and a cathode-ray tube with the resistor.

2. Description of the Related Art

In general, a cathode-ray tube that is used in a color TV receiver includes an electron gun assembly that emits electron beams toward a panel. The electron gun assembly includes a plurality of grid electrodes. Specifically, the electron gun assembly includes various grid electrodes that are supplied with relatively high voltages, as well as an anode that is supplied with an anode voltage.

In this cathode-ray tube with the above-described structure, if a high voltage is applied to each of the grid electrodes from a stem section of the cathode-ray tube, a problem relating to withstand voltage arises. To solve the problem, a resistor for dividing a voltage, which functions as a resistor for an electron gun assembly (hereinafter referred to simply as "resistor"), is incorporated along with the electron gun assembly in the cathode-ray tube. The resistor divides a voltage at a predetermined resistance division ratio, thereby applying a desired high voltage to each of the grid electrodes.

The resistor includes, on an insulating board, an electrode element formed of a low-resistance material, and a resistor element formed of a high-resistance material that is basically similar to the material of the electrode element. A part of the electrode element and the resistor element are coated with an insulating coating layer. A terminal portion that is formed of a metal terminal is electrically connected to the electrode element. The terminal portion is fixed by calking to a through-hole that is formed in the insulating substrate (see, e.g. Jpn. Pat. Appln. KOKAI Publication No. 6-68811).

As regards the above-described electron gun assembly including the resistor, if the arrangement of grid electrodes or the resistance division ratio is altered in order to improve focus characteristics, the position of the terminal of the resistor will also inevitably be altered. It is thus necessary to prepare an insulating substrate that has a different position of the through-hole in accordance with the type of the electron gun assembly, or to prepare a screen having a different pattern. This may lead to a decrease in manufacturing yield.

In addition, it is necessary to adjust the resistance value of the resistor element that is formed on the surface of the insulating substrate of the resistor, thereby making it possible to supply the grid electrode with a voltage that is divided with a predetermined resistance division ratio. There is a case, however, where a predetermined resistance division ratio cannot be obtained in the vicinity of the-output terminal for output to the grid electrode, due to constraints in space of the insulating substrate. Consequently, a desired performance of the electron gun assembly may not be achieved, and the reliability may deteriorate.

BRIEF SUMMARY OF THE INVENTION

The present invention has been made in consideration of the above problems, and its object is to provide a resistor for an electron gun assembly, which can improve a manufacturing yield and enhance reliability, an electron gun assembly with the resistor, and a cathode-ray tube with the resistor.

According to a first aspect of the present invention, there is a provided a resistor for an electron gun assembly, the resistor being configured to apply a voltage, which is divided with a predetermined resistance division ratio, to an electrode that is provided in the electron gun assembly, comprising:

an insulating substrate;

a plurality of electrode elements provided on the insulating substrate;

a resistor element having a pattern for obtaining a predetermined resistance value between the electrode elements;

an insulating coating layer that covers the resistor element;

a plurality of metal terminals that are connected to the associated electrode elements; and a lead-out wire that extends from at least one of the electrode elements and is electrically connected to the resistor element.

According to a second aspect of the present invention, there is a provided an electron gun assembly comprising:

a plurality of electrodes for forming an electron lens section that focuses or diverges an electron beam;

an insulating support member that integrally fixes the plurality of electrodes; and a resistor for the electron gun assembly, the resistor being disposed along the insulating support member and configured to apply a voltage, which is divided with a predetermined resistance division ratio, to at least one of the plurality of electrodes, wherein the resistor for the electron gun assembly comprises:

an insulating substrate;

a plurality of electrode elements provided on the insulating substrate;

a resistor element having a pattern for obtaining a predetermined resistance value between the electrode elements;

an insulating coating layer that covers the resistor element;

a plurality of metal terminals that are connected to the associated electrode elements; and a lead-out wire that extends from at least one of the electrode elements and is electrically connected to the resistor element.

According to a third aspect of the present invention, there is a provided a cathode-ray tube apparatus comprising:

an electron gun assembly including a plurality of electrodes for forming an electron lens section that focuses or diverges an electron beam, and a resistor for the electron gun assembly, the resistor being configured to apply a voltage, which is divided with a predetermined resistance division ratio, to at least one of the plurality of electrodes; and a deflection yoke that generates a deflection magnetic field for deflecting an electron beam that is emitted from the electron gun assembly, wherein the resistor for the electron gun assembly comprises:

an insulating substrate;

a plurality of electrode elements provided on the insulating substrate;

a resistor element having a pattern for obtaining a predetermined resistance value between the electrode elements;

an insulating coating layer that covers the resistor element;

a plurality of metal terminals that are connected to the associated electrode elements; and a lead-out wire that extends from at least one of the electrode elements and is electrically connected to the resistor element.

According to the above-described resistor for an electron gun assembly, an electrode element that is provided at a predetermined position on an insulating substrate and a resistor element that is provided to have a predetermined pattern on the insulating substrate are connected to a lead-out wire that extends from the electrode element, thus making it possible to output a voltage, which is provided with a predetermined resistance division ratio, from a metal terminal that is connected to the electrode element.

Thereby, as regards the electron gun assembly, even if the arrangement of grid electrodes or the resistance division ratio is altered, there is no need to prepare another insulating substrate or to perform a great change in design of the electrode element and the pattern of the resistor element. Such alterations can be executed by extending a lead-out wire from the electrode element and connecting it to a desired position on the resistor element. Therefore, the manufacturing yield can be improved.

Furthermore, a desired resistance division ratio can exactly be obtained by the above structure wherein the lead-out wire is extended to a desired position on the resistor element. Therefore, a desired performance can be achieved in the electron gun assembly, and also a desired performance can be obtained in the cathode-ray tube apparatus including the electron gun assembly.

BRIEF DESCRIPTION OF THE SEVERAL VIEWS OF THE DRAWING

FIG. 6 shows another resistor for an electron gun assembly, which is applicable to the electron gun assembly shown in FIG. 2, in a state in which the resistor is seen through an insulating coating layer that forms an outer surface part of the resistor;

FIG. 7 shows, in enlarged scale, the structure of a part near a terminal portion B in the resistor for the electron gun assembly shown in FIG. 6; and FIG. 8 is a view for explaining the advantageous effect of the present invention, and it specifically indicates confirmation results of occurrence of defects after the resistor for the electron gun assembly is subjected to a withstand-voltage process.

DETAILED DESCRIPTION OF THE INVENTION

A resistor for an electronic gun assembly (hereinafter referred to simply as "resistor") according to an embodiment of the present invention, an electron gun assembly with the resistor and a cathode-ray tube apparatus with the resistor will now be described with reference to the accompanying drawings.

Figure 1:
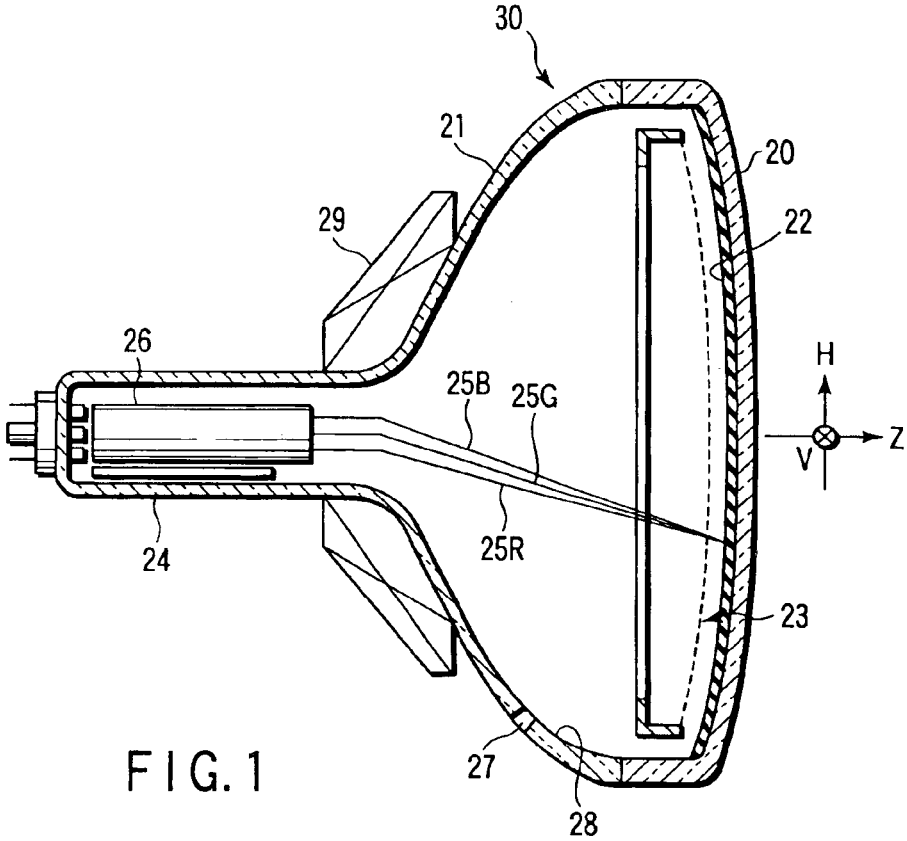
FIG. 1 schematically shows the structure of a color cathode-ray tube apparatus according to an embodiment of the present invention.

As is shown in FIG. 1, a color cathode-ray tube apparatus, which is an instance of a cathode-ray tube apparatus, has a vacuum envelope 30. The vacuum envelope 30 includes a face panel 20 and a funnel 21 that is integrally coupled to the face panel 20. The face panel 20 has a substantially rectangular shape. A phosphor screen 22 is disposed on an inside surface of the face panel 20. The phosphor screen 22 has three-color striped or dot-shaped phosphor layers, which emit blue, green and red light. A shadow mask 23 is disposed to face the phosphor screen 22. The shadow mask 23 has many electron beam passage holes (apertures) in its inside part.

An in-line electron gun assembly 26 is disposed within a cylindrical neck 24, which corresponds to a small-diameter portion of the funnel 21. The electron gun assembly 26 emits three electron beams 25B, 25G and 25R toward the phosphor screen 22 in a tube-axis direction, that is, in a Z-axis direction. These three electron beams comprise a center beam 25G and a pair of side beams 25B and 25R, which are arranged in line in the same horizontal plane, that is, in an H-axis direction.

An anode terminal 27 for supplying a high voltage is provided on the funnel 21. An inside electrically conductive film 28 of graphite, which is connected to the anode terminal 27, is formed on the inner surface of the funnel 21. A deflection yoke 29 is disposed on the outside of the funnel 21. The deflection yoke 29 generates non-uniform deflection magnetic fields for deflecting the three electron beams 25B, 25G and 25R, which have been emitted from the electron gun assembly 26. The deflection yoke 29 includes a horizontal deflection coil that generates a pincushion-shaped horizontal deflection magnetic field, and a vertical deflection coil that generates a barrel-shaped vertical deflection magnetic field.

In the color cathode-ray tube apparatus with the above-described structure, the three electron beams 25B, 25G and 25R emitted from the electron gun assembly 26 are self-converged and focused on the associated color phosphor layers on the phosphor screen 22. The three electron beams 25B, 25G and 25R are deflected by the non-uniform deflection magnetic fields generated by the deflection yoke 29 and scanned over the phosphor screen 22 in the horizontal direction H and vertical direction V. Thus, a color image is displayed on the phosphor screen 22.

Figure 2:
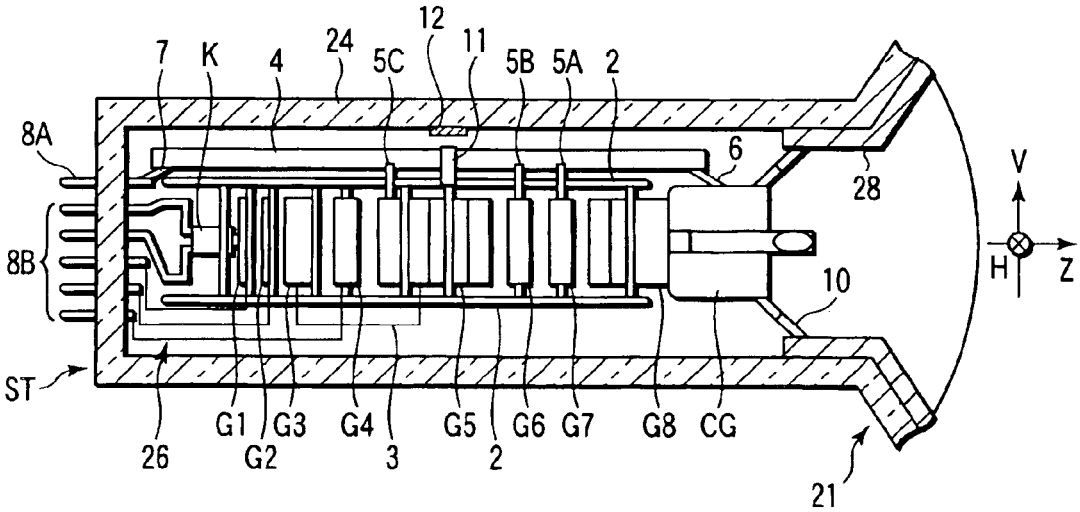
FIG. 2 schematically shows the structure of an electron gun assembly that is applied to the color cathode-ray tube apparatus shown in FIG. 1.

As is shown in FIG. 2, the electron gun assembly 26 includes three cathodes K (B, G, R) (only one of the cathodes is shown in FIG. 2) which are arranged in line in the horizontal direction H, and a plurality of electrodes that are arranged coaxially in the tube-axis direction Z. The plural electrodes, that is, a first grid electrode G1, a second grid electrode G2, a third grid electrode G3, a fourth grid electrode G4, a fifth grid electrode (focus electrode) G5, a sixth grid electrode (first intermediate electrode) G6, a seventh grid electrode (second intermediate electrode) G7, an eighth grid electrode (ultimate acceleration electrode) G8 and a convergence electrode CG, are successively arranged from the cathode K side toward the phosphor screen 22.

The three cathodes K and the first to eighth grid electrodes Gl to G8 are clamped between, and integrally held by, a pair of insulating support members, i.e. bead glasses 2, in the vertical direction V such that they maintain a predetermined mutual positional relationship. The convergence electrode CG is welded to, and electrically connected to, the eighth grid electrode G8.

Each of the first grid electrode G1 and second grid electrode G2 is formed of a relatively thin plate electrode. The third grid electrode G3, fourth grid electrode G4, fifth grid electrode G5 and eighth grid electrode G8 comprise integrally formed cylindrical electrodes that are formed by abutting a plurality of cup-shaped electrodes upon each other. The sixth grid electrode G6 and seventh grid electrode G7 comprise relatively thick plate electrodes. Each of the grid electrodes has three electron beam passage holes for passing three electron beams, the passage holes being arranged in association with the three cathodes K.

A resistor 4 is disposed along the electron gun assembly 26 in the vicinity of the electron gun assembly 26. Specifically, the resistor 4 is disposed in the longitudinal direction of the bead glass 2 along the side surface of the electron gun assembly 26. The resistor 4 divides a high voltage with a predetermined resistance division ratio, and supplies the divided voltages to the respective grid electrodes. One end portion (high voltage side) of the resistor 4 is connected to the eighth grid electrode G8 via a lead-out terminal 6. The other end portion (low voltage side) of the resistor 4 is connected to a stem pin 8A via a lead-out terminal 7. Stem pins 8A and 8B penetrate a stem section ST that seals the neck 24 in the state in which the inside of the tube is kept airtight. The stem pin 8A is grounded directly or grounded via a variable resistor on the outside of the tube. An intermediate portion of the resistor 4 is provided with three lead-out terminals 5A, 5B and 5C in the named order from the one end side. The lead-out terminals 5A, 5B and 5C are connected to the seventh grid electrode G7, sixth grid electrode G6 and fifth grid electrode G5, respectively.

The cathodes K and grid electrodes of the electron gun assembly 26 are supplied with predetermined voltages via the stem pins 8B. Specifically, the cathodes K are supplied with a voltage that is obtained by superimposing an image signal on a DC voltage of about 190 V. The first grid electrode G1 is grounded. A DC voltage of about 800 V is applied to the second grid electrode G2. The third grid electrode G3 and fifth grid electrode G5 are electrically connected via a conductor line within the tube. The fourth grid electrode G4 is supplied with a dynamic focus voltage that is obtained by superimposing an AC component voltage, which varies parabolically in synchronism with deflection of the electron beam, on a DC voltage of about 8 to 9 kV.

The eighth grid electrode G8 is supplied with an anode voltage of about 30 kV. Specifically, the convergence electrode CG that is welded to the eighth grid electrode G8 is provided with a plurality of conductor springs 10 that are put in pressure contact with the inside electrically conductive film 28. The anode voltage is applied to the convergence electrode CG and eighth grid electrode G8 via the anode terminal 27 provided on the funnel 21, the inside electrically conductive film 28 and conductor springs 10.

The anode voltage is supplied to the resistor 4 via the lead-out terminal 6 that is electrically connected to the convergence electrode CG. Predetermined voltages, which are divided with a predetermined resistance division ratio, are applied to the seventh grid electrode G7, sixth grid electrode G6 and fifth grid electrode G5 via the lead-out terminals 5A, 5B and 5C of the resistor 4. For example, the voltage that is applied to the sixth grid electrode G6 corresponds to about 35 to 45% of the anode voltage of about 25 to 35 kV. The voltage that is applied to the seventh grid electrode G7 corresponds to about 50 to 70% of the anode voltage.

In order to stabilize the charge potential of the inner wall of the neck 24 in which the electron gun assembly 26 is disposed, the electron gun assembly 26 is provided with a suppressor ring 11 for formation of a conductor film 12 at a predetermined portion of the inner wall of the neck 24. The suppressor ring 11 is disposed so as to surround the bead glass 2 and resistor 4 at a position where a predetermined grid electrode of the electron gun assembly 26 is fixed. In the embodiment shown in FIG. 2, the suppressor ring 11 is attached, for example, to the fifth grid electrode G5 and surrounds the bead glass 2 and resistor 4.

The respective grid electrodes of the electron gun assembly 26 are supplied with the above-described voltages. Thus, the cathodes K, first grid G1 and second grid G2 form an electron beam generating section that generates electron beams. The second grid electrode G2 and third grid electrode G3 form a prefocus lens that prefocuses the electron beams generated from the electron beam generating section.

The third grid electrode G3, fourth grid electrode G4 and fifth grid electrode G5 form a sub-lens that further focuses the electron beams, which have been prefocused by the prefocus lens. The fifth grid electrode G5, sixth grid electrode G6, seventh grid electrode G7 and eighth grid electrode G8 form a main lens that ultimately focuses the electron beams, which have been prefocused by the sub-lens, on the phosphor screen 22.

The structure of the resistor 4 is described in greater detail.

Figure 3:
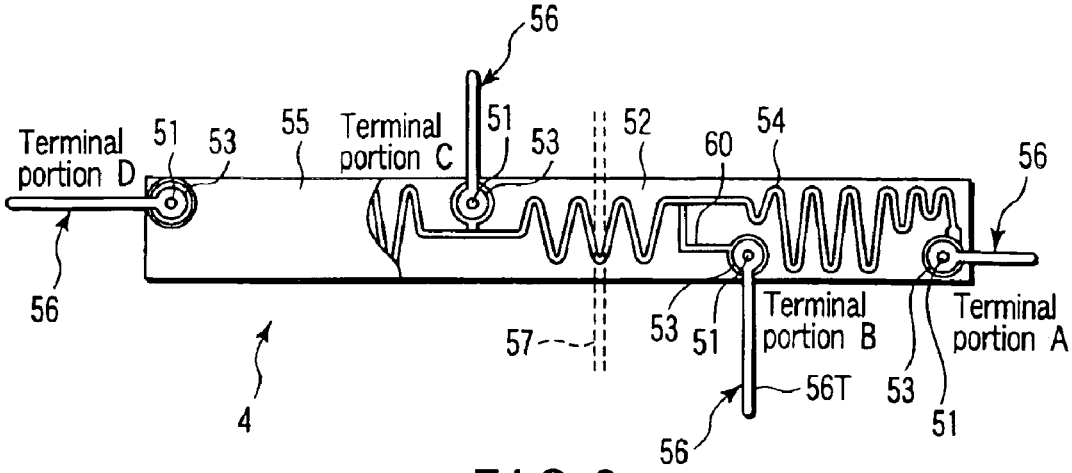
FIG. 3 shows a resistor for an electron gun assembly, which is applicable to the electron gun assembly shown in FIG. 2, in a state in which the resistor is seen through an insulating coating layer that forms an outer surface part of the resistor.
Figure 4:
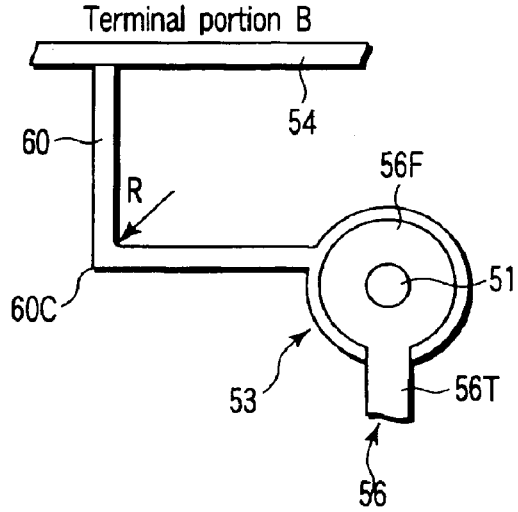
FIG. 4 shows, in enlarged scale, the structure of a part near a terminal portion B in the resistor for the electron gun assembly shown in FIG. 3.
Figure 5:
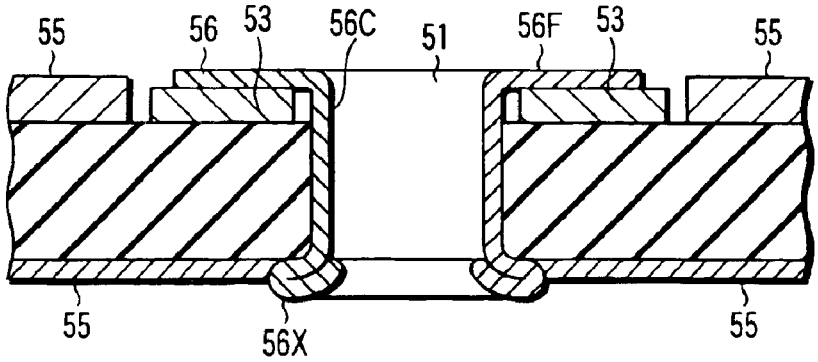
FIG. 5 shows a cross-sectional structure of the part near the terminal portion B shown in FIG. 4.

As is shown in FIGS. 3 to 5, the resistor 4 comprises an insulating substrate 52; a plurality of resistor elements for electrodes, that is, a plurality of electrode elements 53, which are provided on the insulating substrate 52; a resistor element for resistance, that is, a resistor element 54, which is provided on the insulating substrate 52 and has a pattern for obtaining a predetermined resistance value between the electrode elements; an insulating coating layer 55 that covers the resistor element 54; and a plurality of metal terminals 56 that are connected to the associated electrode elements 53.

The insulating substrate 52 is formed of a ceramic-based material that is essentially composed of, e.g. aluminum oxide. The insulating substrate 52 has, e.g. a rectangular plate shape. The insulating substrate 52 has a plurality of preformed through-holes 51 that penetrate the insulating substrate 52 at predetermined positions from the upper side to the lower side. The through-holes 51 are formed at positions corresponding to terminal portions A to D.

The electrode elements 53 are formed of a relatively low resistance material (e.g. a low resistance paste material with a sheet resistance value of 10 kΩ/□) that includes, e.g. a metal oxide such as ruthenium oxide, or a glass material such as borosilicate lead glass. The electrode elements 53 are disposed at predetermined positions on the surface of the insulating substrate 52. To be more specific, the electrode elements 53 are disposed in an insular shape at the terminal portions A to D of the insulating substrate 52 so as to correspond to the associated through-holes 51 formed in the insulating substrate 52. In this case, the through-hole 51 is positioned at a substantially central area of the electrode element 53.

The resistor element 54 is formed of a relatively high resistance material (e.g. a high resistance paste material with a sheet resistance value of 5 MΩ/□) that includes, e.g. a metal oxide such as ruthenium oxide, or a glass material such as borosilicate lead glass. The resistor element 54 is disposed on the surface of the insulating substrate 52 so as to have a predetermined pattern, e.g. a wavy pattern, and it is electrically connected to the respective electrode elements 53. The length, width and thickness of the resistor element 54 are set such that a predetermined resistance value is obtained between the electrode elements 53.

The insulating coating layer 55 is formed of a relatively high resistance material that is essentially composed of, e.g. a transition metal oxide and borosilicate lead glass. The insulating coating layer 55 is disposed so as to cover the upper surface of the insulating substrate 52, which includes the resistor element 54 but excludes portions of the electrode elements 53, and also to cover the lower surface of the insulating substrate 52. Thus, the withstand voltage characteristics of the resistor 4 are improved.

The distance between the electrode element 53 and insulating coating layer 55 may be set to be equal along the entire circumference of the insular electrode element 53. Alternatively, this distance may be set in such an unbalanced fashion that a low-voltage-side part with low possibility of discharge has a narrower distance or no distance.

The metal terminals 56 are formed of, e.g. stainless steel or metal steel with a chromium oxide film. It is desirable that the metal terminals 56 be formed of a nonmagnetic alloy that does not affect deflection magnetic fields generated by the deflection yoke 29, or electric fields for forming electron lenses in the electron gun assembly 26. For instance, the metal terminals 56 are formed of a material with a specific magnetic permeability of 1.01 or less, preferably 1.005 or less, such as a nonmagnetic stainless steel comprising a Fe—Ni—Cr alloy.

Each metal terminal 56 includes a flange portion 56F that is provided at one end thereof, a tongue-like terminal portion 56T that extends from the flange portion 56F, and a cylindrical portion 56C that is continuous with the flange portion 56F. The metal terminal 56 is attached in the following manner. The cylindrical portion 56C is inserted in the through-hole 51 from the upper surface side of the insulating substrate 52, and a distal end portion 56X of the cylindrical portion 56C, which projects from the lower surface of the insulating substrate 52, is calked. Thus, each metal terminal 56 clamps the associated electrode element 53 between its flange portion 54F and the insulating substrate 52, and is electrically connected to the electrode element 53. In this manner, the terminal portions A to D are formed.

The terminal portion A is connected to the lead-out terminal 6 via the metal terminal 56 and functions as a high-voltage supply terminal to which a highest voltage, i.e. an anode voltage, is applied. The terminal portion D is connected to the lead-out terminal 7 via the metal terminal 56 and functions as a low-voltage supply terminal to which a lowest voltage is applied (in this example the terminal portion D is grounded). The terminal portion B is connected to, e.g. the lead-out terminal 5A via the metal terminal 56 and is supplied with a second highest voltage next to the voltage applied to the terminal portion A. The terminal portion C is connected to, e.g. the lead-out terminal 5B via the metal terminal 56 and is supplied with a third highest voltage next to the voltage applied to the terminal portion B. The terminal portions B and C function as output terminals for supplying predetermined grid electrodes with voltages that are divided with a predetermined resistance division ratio. In the example of FIG. 3, a terminal portion that is connected to the lead-out terminal 5C is not shown for the purpose of simple description. It is possible to provide such a terminal portion between the terminal portion C and terminal portion D.

In the meantime, in order to obtain a high image quality in the cathode-ray tube apparatus, it is necessary to enhance focus characteristics on the phosphor screen 22. To achieve this, the specifications of the built-in electron gun assembly 26 may be adjusted. In the adjustment of specifications, principal measures are to alter the shapes and arrangement of the grid electrodes, which constitute the electron gun assembly 26, and to optimize supply voltages.

As regards the resistor 4 that is used to apply high voltages to the grid electrodes of the electron gun assembly 26, the terminal portions A to D are disposed near the associated grid electrodes that are to be supplied with voltages, in consideration of a problem relating to withstand voltages of connection wires between the terminal portions A to D to the associated lead-out terminals. A change in arrangement of the grid electrodes, which aims at improving focus characteristics, will involve a change in arrangement of the terminal portions of the resistor 4. The resistance division ratio in the resistor 4 is determined by adjusting the resistor that is formed on the surface of the insulating substrate 52. However, there is case where a predetermined resistance division ratio cannot be obtained at some positions of terminal portions due to constraints in space of the insulating substrate 52.

To solve the above problem, at least one of a plurality of electrode elements 53 is electrically connected to the resistor element 54 via a lead-out wire 60. Specifically, the electrode element 53 is disposed in association with the terminal portion that is disposed near the grid electrode, to which a voltage is to be applied. There may be a terminal portion at a predetermined position, with which a desired resistance division ratio could not be obtained if the electrode element 53 is directly connected to the resistor element 54. In such a terminal portion, the electrode element 53 is connected to a desired position on the resistor element 54 via the lead-out wire 60.

To be more specific, the lead-out wire 60 is extended from the associated electrode element 53. The lead-out wire 60 is formed of a low-resistance material so as to be integral with the electrode element 53. The lead-out wire 60 is connected to a predetermined position of the resistor element 54 so as to be able to output a divided voltage of a predetermined resistance division ratio from the metal terminal 56 that is connected to the electrode element 53.

Thereby, even if the arrangement of grid electrodes and the resistance division ratio are altered in the electron gun assembly 26, there is no need to prepare another insulating substrate or to perform a great change in design of the electrode element 53 and the pattern of the resistor element 54. Such alterations can be executed by extending the lead-out wire 60 from the electrode element 53 and connecting it to a desired position on the resistor element 54. Therefore, the manufacturing yield can be improved.

Next, a method of manufacturing the above-described resistor 4 is described.

To begin with, an insulating substrate 52 in which through-holes 51 are formed in advance at predetermined positions is prepared. A low-resistance paste material is coated over the insulating substrate 52 by screen printing. A screen that is used in the screen printing has such a pattern as to form doughnut-shaped electrode elements 53 and lead-out wires 60 extending from the annular electrode elements 53, in association with the respective through-holes 51. The coated low-resistance paste material is dried and then baked. Thus, a plurality of insular electrode elements 53 and lead-out wires 60, which are integral with the electrode elements 53, are formed.

Then, a high-resistance paste material is coated over the insulating substrate 52 by screen printing. A screen that is used in this screen printing has a pattern that is so adjusted as to obtain a predetermined resistance value between the electrode elements 53. The coated high-resistance paste material is dried and then baked. Thus, a resistor element 54 is formed such that the entirety of the resistor 4 has a predetermined resistance value of, e.g. $0.1\times10^9$ to $2.0\times10^9$ Ω. The resistor element 54 is directly connected to the insular electrode element 53 or to the lead-out wire 60.

Then, an insulating coating layer 55 is coated on the entire insulating substrate 52 by screen printing so as to cover the resistor element 54, but not to cover peripheral portions of the electrode elements 53. The insulating coating layer 55 is dried and then baked. A screen that is used in this screen printing has such a pattern as to avoid a region corresponding to the outer periphery of the flange portion 56F of each metal terminal 56 that is disposed to cover the electrode element 53.

Subsequently, the cylindrical portion 56C of the metal terminal 56 is inserted in the through-hole 51 from the upper surface side of the insulating substrate 52, and the distal end portion 56X that projects from the lower surface of the insulating substrate 52 is calked. Thereby, the flange portion 56F is electrically connected to the associated electrode element 53.

The resistor 4 is completed through the above-described fabrication steps. In the resistor 4 thus fabricated, the terminal portion B adopts the above-described structure. This structure, however, may be applied to other terminal portions.

The above-described lead-out wire 60 is configured to extend to a desired position on the resistor element 54. Thereby, a desired resistance division ratio can exactly be obtained. Hence, a desired performance of the electron gun assembly 26 can be obtained, and also a desired performance of the cathode-ray tube apparatus including the electron gun assembly 26 can be obtained. Therefore, the reliability is enhanced.

In the cathode-ray tube apparatus to which the above-mentioned high voltages are applied, a withstand-voltage process is performed in the fabrication steps in order to enhance the withstand voltage characteristics. In the withstand-voltage process, a high voltage, which has a peak voltage about twice or thrice as high as a normal operation voltage, is applied. This causes a forcible discharge and removes burr or attached matter from the various grid electrodes, which may lead to deterioration in withstand-voltage characteristics.

At the time of the withstand-voltage process, the fifth grid electrode G5, to which the suppressor ring 11 is attached, is connected to the low-voltage side. Hence, a large potential difference occurs between the suppressor ring 11 and the voltage supply terminal A of the resistor 4. As a result, at the time of the withstand-voltage process, dielectric breakdown occurs between the suppressor ring 11 and the high voltage supply terminal A of the resistor 4 on the insulating coating layer 55 on the surface of the resistor. Consequently, surface creepage occurs.

On the other hand, as regards the resistor 4 that is provided in a high-vacuum atmosphere, there occurs a triple junction since the resistor element 54 and electrode element 53 are covered with the insulating coating layer 55. Hence, in the above-described cathode-ray tube apparatus, if a high voltage is applied, an electric field tends to microscopically concentrate on the triple junction. In addition, since the electrode element 53 is formed of a low-resistance material that is essentially composed of a conductive substance, voids with edges tend to form in the layer of the electrode element 53.

The above-mentioned surface creepage progresses along the high-electric-field concentration region. Consequently, the surface creepage, which occurs on the surface of the insulating coating layer 55 of the resistor 4 when the withstand-voltage process is performed, is pulled to the electric field concentration region that is caused by the triple junction. The surface creepage progresses while letting a pulse current flow to the resistor element 54 that lies under the insulating coating layer 55. Due to heat generation by the energy of surface creepage or void discharge in the electrode element 53, the electrode element 53 and resistor element 54 may peel off or the insulating coating layer 55, which lies immediately above the electrode element 53 and resistor element 54, may peel off. Matter that has peeled off and dropped floats within the cathode-ray tube and may clog the apertures of the shadow masks. In some cases, the resistor element 54 itself may completely be peeled off, and line breakage may occur.

On the other hand, in the above-described resistor 4, the lead-out wire 60 that is formed by a combination of straight-line patterns has a corner portion at a position where the straight-line patterns intersect. For example, in the resistor 4 as shown in FIGS. 3 to 5, the lead-out wire 60 has a shape that is defined by two straight-line patterns combined. The two straight-line patterns intersect substantially at right angles with each other, thus forming a corner portion 60C.

The above-mentioned electric field concentration phenomenon tends to occur, from a macroscopic viewpoint too, at the corner portion 60C of the lead-out wire 60. As a result, it becomes more likely that the electrode element 53 and resistor element 54 may peel off or the insulating coating layer 55 that lies immediately above the electrode element 53 and resistor element 54 may peel off. This phenomenon tends to occur, in particular, at the time of the withstand-voltage process between a position 57 where the suppressor ring 11 is provided and the high-voltage supply terminal A of the resistor 4.

This phenomenon, therefore, needs to be considered when the connection using the lead-out wire 60 is needed at the terminal portion positioned between the position 57 of suppressor ring 11 and the high-voltage supply terminal A, that is, at the terminal portion B.

In a resistor 4 shown in FIGS. 6 and 7, a lead-out wire 60 is curved. The lead-out wire 60 has no corner portion where an electric field concentration phenomenon tends to occur. It is possible, therefore, to prevent the electrode element 53, resistor element 54, lead-out wire 60 and insulating coating layer 55 from peeling off due to the electric field concentration phenomenon. This configuration is particularly effective in a case where the lead-out wire 60 is needed at the terminal portion B positioned between the position 57 of suppressor ring 11 and the high voltage supply terminal A.

Even where the lead-out wire 60 is curved, if the radius of curvature of the arcuate pattern is too small, the electric field concentration phenomenon may easily occur like the corner portion 60C shown in FIG. 4.

The resistor 4 that is fabricated by the above-described method was built in the cathode-ray tube and subjected to the withstand-voltage process. It was confirmed how the radius of curvature R of the arcuate pattern of the lead-out wire 60 affected peeling of the insulating coating layer 55 after the withstand-voltage process. Assume that the radius of curvature R is defined by the shape of an inner edge 60X of the lead-out wire 60. FIG. 8 shows the confirmation results.

As is shown in FIG. 8, in the case where the lead-out wire 60 was formed by the combination of the straight-line patterns, as shown in FIG. 4, peeling of the insulating coating film 55 due to peeling of, e.g. the lead-out wire 60 and resistor element 54 was confirmed in resistors 4 of that number of tested products, which corresponds to 18% of all the tested products.

On the other hand, in the case where the lead-out wire 60 was formed by the arcuate pattern, the number of resistors 4, in which peeling of the lead-out wire 60 and insulating coating layer 55 was confirmed, was greatly reduced. As the radius of curvature R decreases, it is more likely that a corner portion similar to that shown in FIG. 4 is formed, and peeling was confirmed in resistors 4, the number of which corresponds to 10% or more. In the case where the radius of curvature R was set at 0.5 mm or more, peeling was not confirmed in any of the resistors 4. Therefore, in the case where the lead-out wire 60 is formed of an arcuate pattern, it is desirable that the radius of curvature R be set at 0.5 mm or more.

In the present embodiment, experiments were conducted with respect to radii of curvature, the maximum of which was 15.0 mm. It turned out that with the radius of curvature R exceeding about 10.0 mm, interference occurred between the mesh angle of the print screen, which is used in mesh-type printing, and the pattern of the lead-out wire 60, and blurring occurred on the pattern. From the standpoint of a counter-measure to a pattern error at a time of overlap-print of patterns, or a counter-measure for preventing blurring due to a screen mesh used in printing, it is preferable to set the upper limit of the radius of curvature R of the lead-out wire 60 at 10.0 mm or less.

As has been described above, in the cathode-ray tube apparatus that is used in the state in which the resistor element 54 and electrode element 53 of the resistor 4 are connected by the lead-out wire 60 that extends from the electrode element 53, the lead-out wire 60, which is disposed between the suppressor ring 11 attached to the predetermined electrode of the electron gun assembly 26 and the high-voltage supply terminal A of the resistor 4, is formed in a curved shape, and the radius of curvature of the arcuate pattern of the curved lead-out wire 60 is set at a value that is not less than 0.5 mm and not greater than 10.0 mm.

Thereby, no corner portion is formed on the lead-out wire 60, and an electric field concentration region in the withstand-voltage process can be reduced. In addition, at the time of surface creepage between the suppressor ring and the high-voltage supply terminal A in the withstand-voltage process that is executed in the fabrication steps of the cathode-ray tube apparatus, it becomes possible to efficiently prevent peeling of the resistor element 54, electrode element 53, lead-out wire 60 and insulating coating layer 55. Furthermore, possible clogging of apertures of the shadow mask due to peeled-off matter can be prevented.

By increasing the radius of curvature R of the lead-out wire 60, the length of the lead-out wire 60 can be decreased and the resistance value of the electrode element 53 that is integral with the lead-out wire 60 can be reduced. Accordingly, it becomes easier to estimate the resistance value when the resistor element 54 is designed. Besides, the possibility of a resistance value read error due to the resistance value of the electrode element 53 decreases, and the quality of the resistor 4 can be stabilized. Hence, the quality of the electron gun assembly using the resistor 4 and the cathode-ray tube using the resistor 4 can also be stabilized, and the reliability enhanced.

In the above-described embodiment, the curved lead-out wire 60 is adopted only at one location of the terminal portion B. Needless to say, the curved lead-out wire 60 may be adopted at a plurality of locations.

In the above embodiment, the resistor for the electron gun assembly is applied to the color cathode-ray tube apparatus. Needless to say, the resistor for the electron gun assembly, which has the above-described structure, is applicable to other electron tubes that require voltage-division resistors.

The present invention is not limited to the above-described embodiments. At the stage of practicing the invention, various modifications and alterations may be made without departing from the spirit of the invention. The embodiments may properly be combined and practiced, if possible. In this case, advantages are obtained by the combinations.

The present invention may provide a resistor for an electron gun assembly, which can improve a manufacturing yield and enhance reliability, an electron gun assembly with the resistor, and a cathode-ray tube with the resistor.

What is claimed is:

1. A resistor for an electron gun assembly, the resistor being configured to apply a voltage, which is divided with a predetermined resistance division ratio, to an electrode that is provided in the electron gun assembly, comprising:

an insulating substrate;

a plurality of electrode elements provided on the insulating substrate;

a resistor element having a pattern for obtaining a predetermined resistance value between the electrode elements;

an insulating coating layer that covers the resistor element;

a plurality of metal terminals that are connected to the associated electrode elements;

a lead-out wire that extends from at least one of the electrode elements and is electrically connected to the resistor element;

wherein the lead-out wire is formed in a curved shape and has an arcuate pattern, and the arcuate pattern has a radius of curvature that is not less than 0.5 mm and not greater than 10.0 mm.

2. An electron gun assembly comprising:

a plurality of electrodes for forming an electron lens section that focuses or diverges an electron beam; an insulating support member that integrally fixes said plurality of electrodes; and a resistor for the electron gun assembly, the resistor being disposed along the insulating support member and configured to apply a voltage, which is divided with a predetermined resistance division ratio, to at least one of said plurality of electrodes, wherein the resistor for the electron gun assembly comprises:

an insulating substrate;

a plurality of electrode elements provided on the insulating substrate;

a resistor element having a pattern for obtaining a predetermined resistance value between the electrode elements;

an insulating coating layer that covers the resistor element;

a plurality of metal terminals that are connected to the associated electrode elements;

a lead-out wire that extends from at least one of the electrode elements and is electrically connected to the resistor element; and wherein the electron gun assembly includes a suppressor ring that surrounds the insulating support member and the resistor for the electron gun assembly at a position where a predetermined one of the electrodes is fixed, the metal terminals are provided in association with a high-voltage supply terminal, which is supplied with a highest voltage, and an output terminal for applying a voltage, which is divided with a predetermined resistance division ratio, to the electrode of the electron gun assembly, and the lead-out wire is positioned between a position of the suppressor ring and the high-voltage supply terminal.

3. The electron gun assembly, according to claim 2, wherein the lead-out wire has an arcuate pattern, and the arcuate pattern has a radius of curvature that is not less than 0.5 mm and not greater than 10.0 mm.

4. A cathode-ray tube apparatus comprising:

an electron gun assembly including a plurality of electrodes for forming an electron lens section that focuses or diverges an electron beam, and a resistor for the electron gun assembly, the resistor being configured to apply a voltage, which is divided with a predetermined resistance division ratio, to at least one of said plurality of electrodes; and a deflection yoke that generates a deflection magnetic field for deflecting an electron beam that is emitted from the electron gun assembly, wherein the resistor for the electron gun assembly comprises:

an insulating substrate;

a plurality of electrode elements provided on the insulating substrate;

a resistor element having a pattern for obtaining a predetermined resistance value between the electrode elements;

an insulating coating layer that covers the resistor element;

a plurality of metal terminals that are connected to the associated electrode elements;

a lead-out wire that extends from at least one of the electrode elements and is electrically connected to the resistor element; and wherein the electron gun assembly includes a suppressor ring that surrounds the insulating support member and the resistor for the electron gun assembly at a position where a predetermined one of the electrodes is fixed, the metal terminals are provided in association with a high-voltage supply terminal, which is supplied with a highest voltage, and an output terminal for applying a voltage, which is divided with a predetermined resistance division ratio, to the electrode of the electron un assembly, and the lead-out wire is positioned between a position of the suppressor ring and the high-voltage supply terminal.

5. The cathode-ray tube apparatus according to claim 4, wherein lead-out wire has an arcuate pattern, and the arcuate pattern has a radius of curvature that is not less than 0.5 mm and not greater than 10.0 mm.

* * * * *